United States Patent [19]

Ellis

[11] Patent Number: 4,984,711

[45] Date of Patent: Jan. 15, 1991

[54] WINE DISPENSER

[76] Inventor: Charles V. Ellis, 241 Tremont St., Newton, Mass. 02158

[21] Appl. No.: 425,488

[22] Filed: Oct. 23, 1989

[51] Int. Cl.[5] ..... B65D 83/14

[52] U.S. Cl. ..... 222/82; 222/83; 222/152; 222/399; 222/400.7

[58] Field of Search ..... 222/82, 83, 152, 153, 222/399, 400.7, 132, 481.5

[56] References Cited

U.S. PATENT DOCUMENTS

| | | | |
|---|---|---|---|
| 1,041,699 | 10/1915 | Thompson | 222/148 |
| 3,186,599 | 6/1965 | Levinson et al. | 222/82 |
| 3,883,043 | 5/1975 | Lane | 222/82 |
| 4,011,971 | 3/1977 | Haydon | 222/399 |
| 4,392,578 | 7/1983 | Fipp et al. | 215/231 |
| 4,473,174 | 9/1984 | Heuser | 222/152 |
| 4,475,576 | 10/1984 | Simon | 141/98 |
| 4,595,121 | 6/1986 | Schultz | 222/1 |
| 4,674,662 | 6/1987 | Bergstrom et al. | 222/399 |
| 4,691,842 | 9/1987 | Foures | 222/1 |
| 4,706,847 | 11/1987 | Sankey et al. | 222/1 |
| 4,856,680 | 8/1989 | Sitton | 222/152 |

*Primary Examiner*—Andres Kashnikow
*Assistant Examiner*—A. Pomrening
*Attorney, Agent, or Firm*—John P. McGonagle

[57] ABSTRACT

A wine dispensing device for dispensing individual portions of wine from a bottle while protecting the remaining wine in the bottle against contact with the ambient air. The device uses a source of a special inert gas/carbon dioxide gas mixture connected to a delivery assembly coupled to a bottle of wine through the bottle's cork for dispensing the contents and supply the blanketing gas mixture to the exclusion of undesired ambient air. The delivery assembly is so designed that is purged of ambient air prior to and during dispensing of the contents of the bottle.

11 Claims, 4 Drawing Sheets

WINE DISPENSER

BACKGROUND OF THE INVENTION

This invention relates to a dispenser for wine, and more particularly to a dispenser which permits a bottle of wine to be opened and served in individual portions over an extended period of time without subjecting the remaining wine in the bottle to the adverse effects of air.

Wine spoils when the oxygen in the ambient air reacts with it. Noticeable spoilage usually happens within a day or two, even if the wine is resealed and/or refrigerated. Fine wines often will noticeably deteriorate within hours. The spoilage is due to the oxidation process and aerobic microorganismic action of the wine interacting with ambient air and results in a musty odor, flat flavor, discoloration and acidification of the wine. Even slight contact between the wine and ambient air will begin the oxidation process.

The prior art has taken three basic approaches to protecting uncorked wine from contact harmful oxygen: blanketing with nitrogen, vacuuming the air out of a partially dispensed bottle, or physically barring air from contacting the wine. However, the fundamental limitation with each of these approaches is that the bottle of wine is uncorked. This process alone begins the wine's deterioration through the initial wine contact with air when the cork is removed. Enough oxygen instantaneously reacts with the wine to start degradation. No blanketing or vacuuming arrangement can remedy this state once the cork has been pulled. The best of the devices using one of the above approaches can only extend the wine's life to a maximum of three weeks.

The prior art shows several patents which attempt to solve this problem by inserting an inert gas through the cork and extracting the wine without removing the cork. See, for example, U.S. Pat. Nos. 3,883,043 and 4,011,971. Both of these patents disclose devices having a hollow needle or thin tube which is inserted through the bottle cork into the interior of the bottle through which wine can be withdrawn from the bottle and through which an inert gas can be directed into the space above the surface of the wine. The fundamental limitation of these two patents and similar type devices is that the very insertion of the needles and/or tubes through the cork introduces air, i.e., the ambient air in the needle and/or tube itself. Although small in amount, the air stored therein is enough to begin oxidation and limit the outer time limit before the wine noticeably deteriorates, generally approximately three weeks. A second serious limitation of these type devices is that even a small needle-sized opening will become clogged with cork particles as the needle or tube passes through the cork. Thus, a viable wine dispenser of this type will at least require a completely closed, insertion surface.

SUMMARY OF THE INVENTION

The present invention is an inexpensive wine preservation and dispensing system designed to allow bottled wine to be consumed by the glass. The system preserves the wine remaining in the bottle for up to six months or more.

Accordingly, it is an objective of the present invention to provide a dispenser for wine which permits a bottle to be opened and served in individual portions over an extended period of time without subjecting the remaining wine in the bottle to the deleterious effects of air.

It is another object of the invention to provide a dispenser for wine bottles which does not require removal of the cork.

It is still another object of the invention to provide a hollow screw which may be inserted through the cork without the introduction of any air for the purposes of removing wine and introducing a blanketing inert gas mixture.

Other and further objects, as well as various advantages and features of novelty which characterize the invention are pointed out with particularity in the claims annexed hereto and forming a part hereof. However, for a better understanding of the invention, its objectives and advantages obtained by its use, reference should be had to the drawings which form a further part hereof, and to the accompanying descriptive matter in which there is illustrated and described a preferred embodiment of the invention.

DETAILED DESCRIPTION OF THE INVENTION

Figure 1:
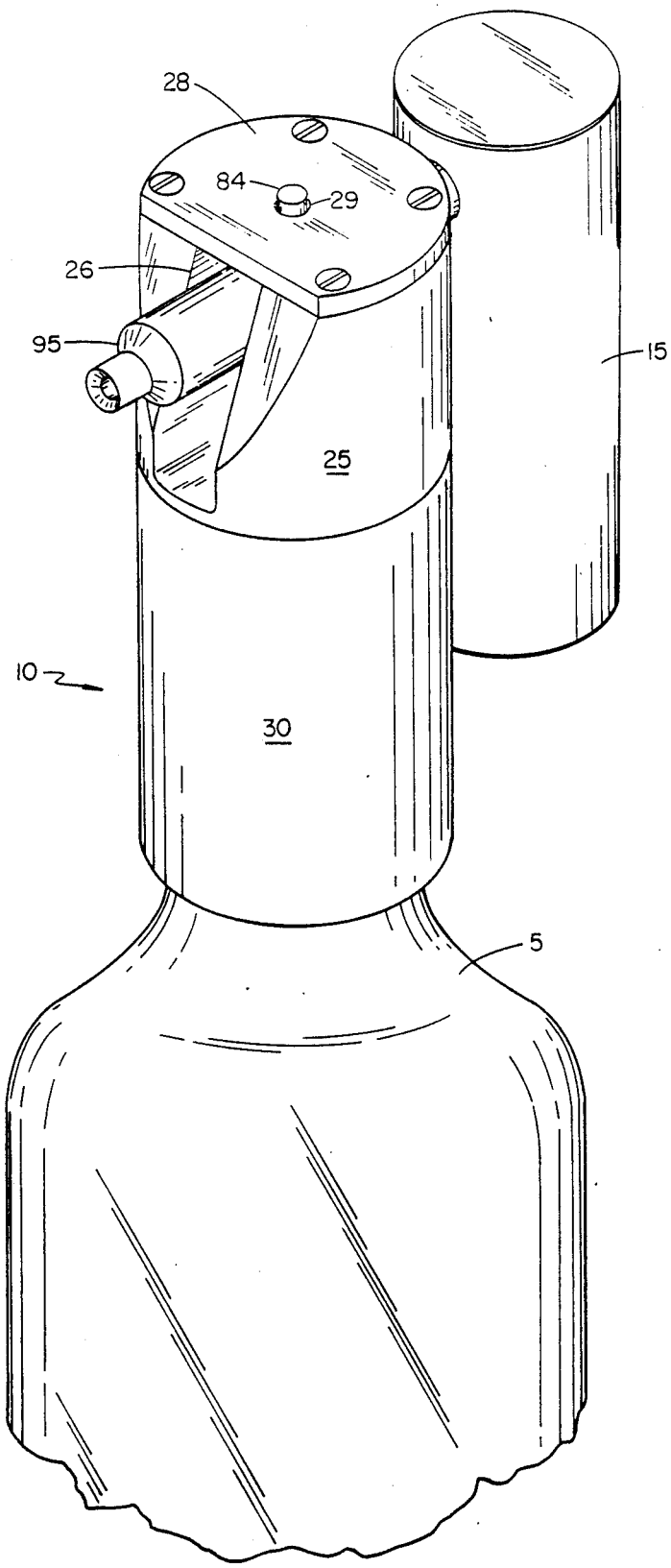
FIG. 1 is a perspective view of one embodiment of present invention.
Figure 2:
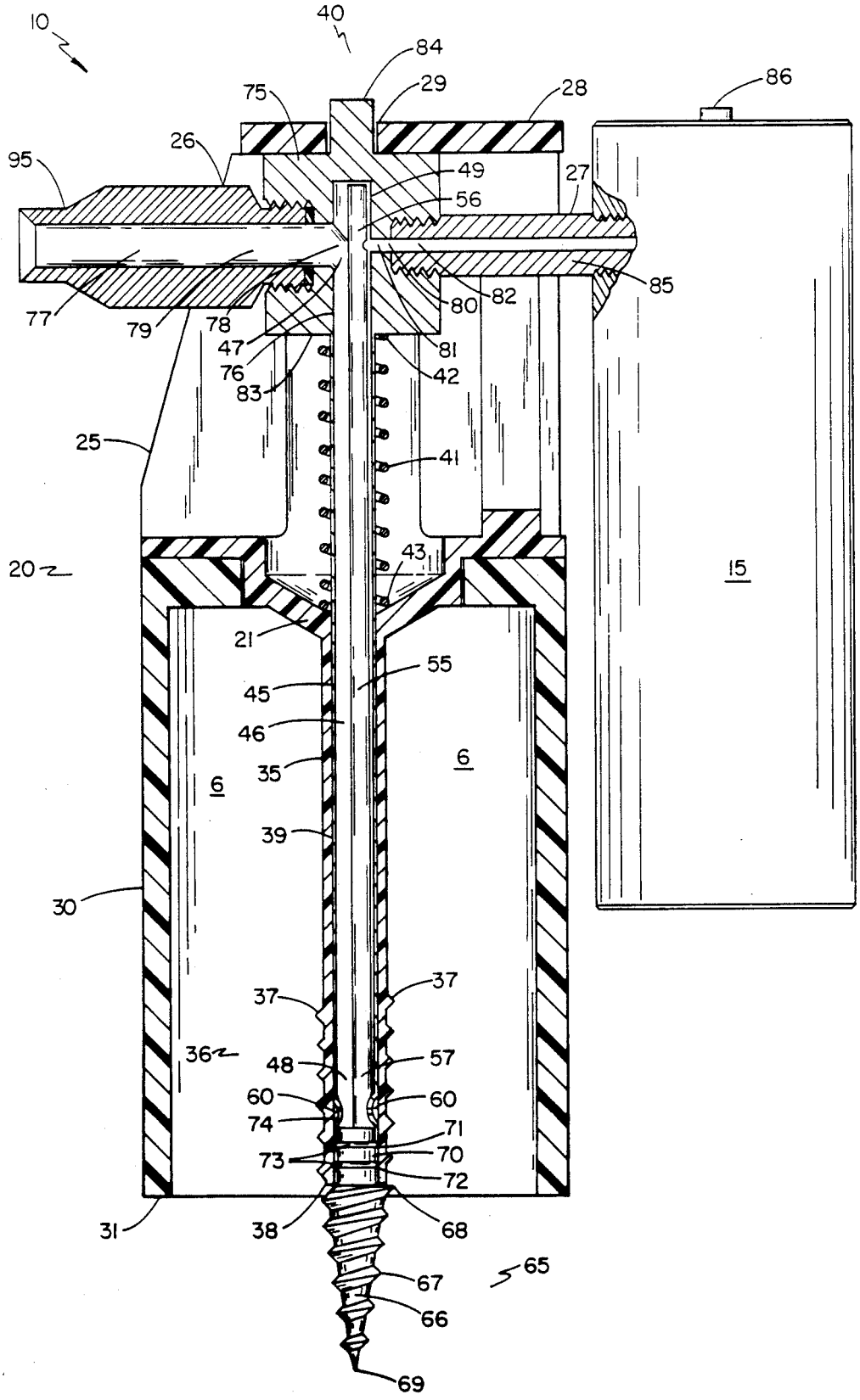
FIG. 2 is a side partical cross-section view of the cap portion of the invention.

Referring to the drawings in detail wherein like numerals indicate like elements, there is shown a wine dispenser according to the present invention positioned over a wine bottle 5. The invention has two main sections, a cap 10 and a gas canister 15. The cap 10 delivers gas from the canister 15 to the bottle 5 and wine to the user. The canister 15 contains an inert blanketing gas mixture and is attached directly to the cap 10 and remains attached until the bottle 5 is emptied of its contents. The quantity of gas in the canister 15 in this embodiment is premeasured, i.e., one canister 15 will last for one full bottle of wine, or two half bottles. The gas in the canister 15 is specific, i.e., a red canister is comprised of a gas mixture suited best for the preservation of red wines, while a white canister is for white wines.

The cap 10 is comprised of a base mounting sleeve 20 and a delivery assembly 40. The base mounting sleeve 20 has a generally cylindrical shape, the lower portion 30 of which is hollow and fits over the wine bottle neck 6. The upper portion 25 of the base mounting sleeve 20 is also hollow and has two slots, one forward 26 and one rearward 27. The upper portion has a top cover 28 with a small center opening 29. The inner diameter of the upper portion 25 is approximately one-half of the inner diameter of the lower portion 30. The length of the upper portion 25 is approximately one-third of the length of the base mounting sleeve 20 and the length of the lower portion 30 being approximately two-thirds of the length of the base mounting sleeve 20. At the junction of the lower 30 and upper 25 portions of the base mounting sleeve 20 there is an internal radial flange having an inner diameter approximately one-half that of the inner diameter of the upper portion 25. Extending downwardly from the radial flange 21 is hollow cylindrical tube 35 with an inner diameter approximately equal to the inner diameter of the radial flange 21. The tube 35 extends lengthwise to the bottom 31 of the base mounting sleeve 20. The exterior portion of the lower section 36 of the tube 35 is threaded with accelerated, multi-lead, lag bolt style threads 37.

The delivery assembly 40 is comprised of a hollow screw assembly 45, spring 41, channel element 75, gas feed element 85 and pourer 95. The hollow screw assembly 45 is concentrically positioned within the base mounting sleeve 20 and consists of an elongated liquid tube 46, elongated gas tube 55, and tip structure 65. The liquid tube 46 is concentrically positioned within the base mounting sleeve cylindrical tube 35 and has two ends, one end 47 of which terminates in the channel element 75 and the other end 48 of which terminates in the tip structure 65. The gas tube 55 is longitudinally positioned within the liquid tube 46 against the inner wall 49 of the liquid tube 46. The radial diameter of the gas tube 55 is approximately one-third that of the liquid tube 46. The gas tube 55 also has two ends, one end 56 of which terminates in the channel element 75 and the other end 57 of which terminates in the tip structure 65.

The channel element 75 is a "T" shaped dual channel device with a main channel 76 into which the hollow screw assembly 45 terminates and two branch channels 77 and 80 splitting off from the main channel 76. Both the liquid tube upper end 47 and gas tube upper end 56 feed into the channel element main channel 76. The liquid tube upper end 47 connects to the inner end 78 of one branch channel 77, and the gas tube upper end 56 connects to the beginning end 81 of the other branch channel 80. Both channels 76 and 77 are completely separate. The outer end 79 of the liquid branch channel 77 terminates in a conventional, hollow pourer 95. The outer end 82 of the gas branch channel 80 is connected to a gas canister connecting arm 85.

The channel element 75 is contained within the base mounting sleeve upper portion 25. The channel element has a small protrusion 84 on top which fits into the center opening 29 of the top cover 28 of the base mounting sleeve upper portion. This keeps the delivery assembly 40 centered when the cap 10 is mounted onto a wine bottle 5. The pourer 95 is positioned through the upper portion's forward slot 26. The gas canister connecting arm 85 is positioned through the upper portion's rearward slot 27. A spring 41 is positioned around that portion of the hollow screw assembly 45 contained within the upper portion 25 of the base mounting sleeve 20. The top end 42 of the spring 41 abuts the channel element bottom 83 through which the main channel 76 is formed, and the spring lower end 43 rests on the base mounting sleeve internal radial flange 21.

The hollow screw assembly 45 terminates in a tip structure 65. The tip structure 65 is solid and has a generally cylindrical shape. The tip structure 65 has three sections. The bottom most section 66 extends beneath the base mounting sleeve cylindrical tube bottom 38 and has threaded accelerated, multiple-lead, lag bolt style threads 67 about its external surface. The top part 68 of the bottom section 66 abuts the base mounting sleeve cylindrical tube bottom 38 and has a diameter which matches that of the cylindrical tube 38. The tip structure bottom section 66 then tapers downward to a point 69. The midsection 70 of the tip structure 65 is positioned concentrically just within the cylindrical tube 35 and has an outer diameter slightly less than the inner diameter of the cylindrical tube 35. The midsection 70 has two radial grooves 71 and 72 in parallel with each other. The radial grooves 71 and 72 each have a radial gasket 73 fitted into the grooves 71 and 72 and protruding out against the inner wall 39 of the cylindrical tube 35. The tip structure top section 74 is shaped so that its radial diameter is less than the diameter of the tip structure midsection 70. This results in a radial cavity 60 formed between the tip structure top section 74 and the inner wall 39 of the cylindrical tube. The liquid tube lower end 48 terminates and opens into this cavity 60 as does the gas tube lower end 57.

Figure 3:
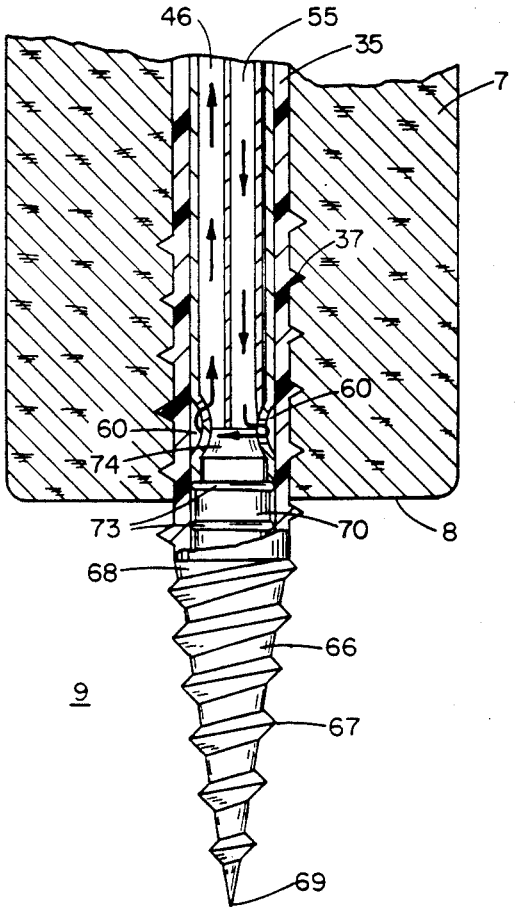
FIG. 3 is an enlarged cross-sectional view of the cap's hollow screw tip portion illustrating the flow of inert gas after insertion through the cork.

The gas canister 15 is a conventional style gas canister but is filled with a special inert gas mixture more fully described below. In this embodiment, the canister connecting arm 85 which is hollow is tubularly connected to a gas release valve 86 within the canister 15. As the gas release valve 86 is opened, gas is released from the canister 15 into the connecting arm 85 through the channel element 75 into the gas tube 55. The gas enters the radial cavity 60 and into the liquid tube 46 and up through the channel element 75 out of the purer 95. All air and oxygen is thereby purged from the system. See FIG. 3.

Figure 4:
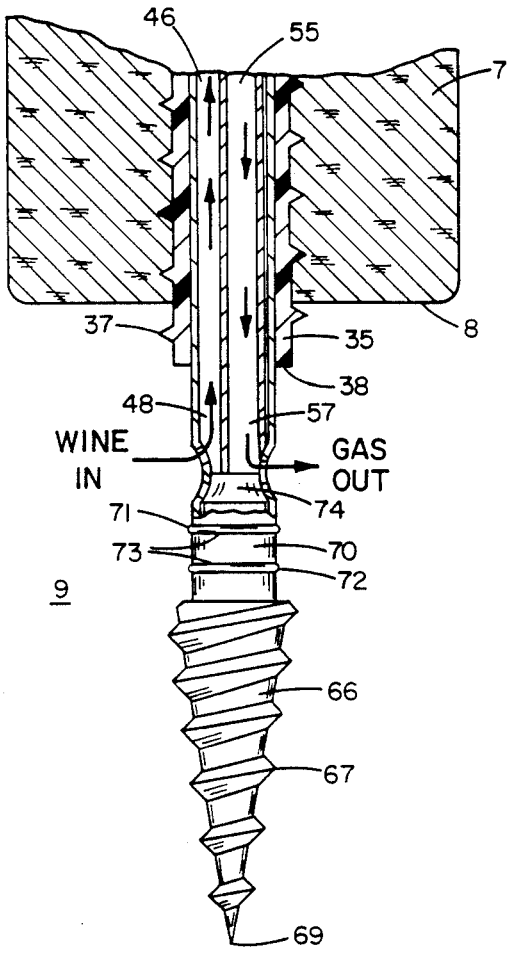
FIG. 4 is an enlarged cross-sectional view of the cap's hollow screw tip portion illustrating the flow of inert gas and wine during wine pouring.

In operation the cap 10 with canister 15 attached is positioned over an upright wine bottle 5 onto the bottle neck 6. The combination of the tip structure bottom section 66 and base mounting sleeve cylindrical tube lower section 36 acts on the wine bottle cork 7 like a convention cork screw. When the cylindrical tube bottom 38 just breaks through the cork bottom 8, the cork screw action is halted. The gas canister 15 is activated as described above and all air is purged from the system. The canister connecting arm 85 is then pressed downward thereby driving the channel element 75 and the attached hollow screw assembly 45 downward through the cylindrical tube 35. The hollow screw assembly 45 is driven downward until the entire tip structure 65 is below the bottom 38 of the cylindrical tube 35. The gas flows into the head space 9 between the cork bottom 8 and the wine as the wine flows out of the bottle through the liquid tube 46, channel element 75 and pourer 95. The invention never permits the wine in the bottle to come into contact with ambient air until the wine leaves the bottle 5. See FIG. 4. As soon as the user releases the downward pressure on the connecting arm 85, the spring 41, which was compressed during the pouring operation, urges the channel element 75 and the attached hollow screw assembly 45 upward. This has the effect of pulling the tip structure 65 back into the cylindrical tube 35 and sealing off the liquid tube 46 and gas tube 55, thereby continuing the isolation of the head space 9 from ambient air even when the gas supply in the canister 15 is turned off.

The gas mixture used is designed to match as closely as possible the carbon dioxide content in the head space 9. In this embodiment of the invention a mixture of 90% argon gas and 10% carbon dioxide gas is used for red wines, and a mixture of 80% argon gas and 20% carbon dioxide gas is used for white wines. Argon is used because it is inert, easy to use, readily available and because it will not affect taste or smell. The carbon dioxide content of the gas should not exceed 0.106 grams per 100 milliliters, i.e., approximately 20% in concentration. Greater concentrations will cause flavor changes, spritziness and will accelerate the chemical aging processes in the wine. Using the above invention and the above gas mixtures, wine preservation in a partially used bottle has approached six months.

The design of the hollow screw assembly tip structure bottom section 66 and cylindrical tube lower threaded section 36 so that shredding of the cork is avoided is important as a shredded cork could be another source of air into the head space 9. The inventor has found that unpigmented nylon or ultra high molecular weight unpigmented polyethylene outer threads substantially reduce friction through the cork screw. When combined with accelerated, multiple-lead, lag bolt style threads and a 0.25 inch outer diameter thread limit, shredding is eliminated, while a sufficient pour remains. One of the major difficulties with prior art devices is their tendency to shred corks. Double and even triple screw threading, i.e., multiple-lead threading, are needed to eliminate this problem. The tip structure 65 is solid thereby eliminating any problems with the cork clogging the hollow screw assembly 45.

It is understood that the above-described embodiment is merely illustrative of the application. Other embodiments may be readily devised by those skilled in the art which will embody the principles of the invention and fall within the spirit and scope thereof.

I claim:

1. A wine dispensing device coupled to a bottle of wine through the bottle's cork for dispensing the contents and supplying a desired gas from an attached gas source to the exclusion of undesired ambient air, comprising:

A. a base mounting sleeve having a generally cylindrical shape, comprising:

a hollow lower portion which fits over a wine bottle neck;

a hollow upper portion;

an internal radial flange at the junction of said lower and upper portions; and a hollow cylindrical tube extending downward from said radial flange, having an inner wall whose diameter is approximately equal to the inner diameter of said radial flange, and having a lower section whose exterior portion is threaded;

in combination with:

B. a delivery assembly, comprising:

a hollow screw assembly concentrically positioned within said base mounting sleeve, comprising:

an elongated liquid tube concentrically positioned within said base mounting sleeve cylindrical tube and having an inner wall and upper and lower ends;

an elongated gas tube longitudinally positioned within said liquid tube and having upper and lower ends; and a tip structure terminating the hollow screw assembly and having three sections, the top section of which is concentrically positioned within said base mounting sleeve cylindrical tube and has an outer diameter less than the inner diameter of said cylindrical tube inner wall, a midsection positioned concentrically just within said cylindrical tube and having an outer diameter slightly less than the inner diameter of said cylindrical tube and greater than the outer diameter of said top section and thereby forming a radial cavity between said tip structure top section and said inner wall of said cylindrical tube into which cavity said liquid and gas tube lower ends terminate and open, and a bottom section extending beneath said cylindrical tube tapering downward to a point and whose exterior whose exterior a "T" shaped dual channel element contained within said base mounting sleeve upper portion having a main channel into which said hollow screw assembly terminates, and two branch channels splitting off from said main channel, into one of which said liquid tube joins and into the other one of which said gas tube joins;

a spring positioned around that portion of the hollow screw assembly contained within said upper portion of said base mounting sleeve and having a top end and a bottom end, the top end of which abuts said channel element and the top end of which rests on said base mounting sleeve internal radial flange;

a gas feed element interconnecting said gas branch channel to said attached gas source; and a pourer connected to said liquid branch channel.

2. The combination according to claim 1 wherein the desired gas comprises:

a mixture of 90% inert gas and 10% carbon dioxide for red wines; and a mixture of 80% inert gas and 20% carbon dioxide for white wines.

3. The combination according to claim 2 wherein:

the inert gas is argon.

4. The combination according to claim 3 wherein:

said hollow upper portion has two slots, one forward and one rearward;

said gas feed element is positioned through said rearward slot; and said pourer is positioned through said forward slot.

5. A combination in accordance with claim 4 wherein:

said tip structure midsection has two radial grooves in parallel with each other and a radial gasket fitted into each said groove and protruding out against said cylindrical tube inner wall.

6. A combination in accordance with claim 5 wherein:

said tip structure bottom section has a top part which abuts said cylindrical tube and which has a diameter which matches that of said cylindrical tube.

7. A combination in accordance with claim 6 wherein:

said base mounting sleeve upper portion has an inner diameter equal to approximately one-half of the inner diameter of said lower portion.

8. A combination in accordance with claim 7 wherein:

said internal radial flange has an inner diameter equal to approximately one-half of the inner diameter of said upper portion.

9. A combination in accordance with claim 8 wherein:

said gas tube is longitudinally positioned within said liquid tube against said inner wall of the liquid tube.

10. A combination in accordance with claim 9 wherein:

said threads on said cylindrical tube lower section and said tip structure bottom section are accelerated, multiple-lead, lag bolt style threads.

11. A combination in accordance with claim 10 wherein:

said tip structure is solid.

* * * * *